US008228272B2

(12) United States Patent
Peng et al.

(10) Patent No.: US 8,228,272 B2
(45) Date of Patent: Jul. 24, 2012

(54) BACKLIGHT DEVICE AND LIQUID CRYSTAL DISPLAY INCORPORATING THE BACKLIGHT DEVICE

(75) Inventors: Huajun Peng, Hong Kong (CN); Ya-Hsien Chang, Hong Kong (CN); Chen Jung Tsai, Hong Kong (CN)

(73) Assignee: Hong Kong Applied Science And Technlogy Research Institute Company Limited, Shatin (HK)

( * ) Notice: Subject to any disclaimer, the term of this patent is extended or adjusted under 35 U.S.C. 154(b) by 1308 days.

(21) Appl. No.: 11/707,517

(22) Filed: Feb. 16, 2007

(65) Prior Publication Data

US 2008/0150853 A1 Jun. 26, 2008

(30) Foreign Application Priority Data

Dec. 22, 2006 (HK) ..... 06114098.6

(51) Int. Cl.
*G09G 3/36* (2006.01)

(52) U.S. Cl. ..... 345/87; 345/89; 345/102; 345/690

(58) Field of Classification Search ..... 345/204, 345/690, 694, 87–89, 102
See application file for complete search history.

(56) References Cited

U.S. PATENT DOCUMENTS

| | | | | |
|---|---|---|---|---|
| 6,891,672 | B2 | 5/2005 | Whitehead et al. | |
| 7,064,740 | B2 | 6/2006 | Daly | |
| 2004/0257318 | A1 | 12/2004 | Itoh | |
| 2005/0184952 | A1 * | 8/2005 | Konno et al. | 345/102 |
| 2005/0231978 | A1 | 10/2005 | Kvenvold et al. | |
| 2005/0248524 | A1 * | 11/2005 | Feng et al. | 345/102 |
| 2006/0007103 | A1 | 1/2006 | Oh et al. | |
| 2006/0007112 | A1 | 1/2006 | Park | |
| 2006/0109389 | A1 | 5/2006 | Ichikawa et al. | |
| 2006/0262077 | A1 | 11/2006 | Terasaka | |
| 2006/0262078 | A1 * | 11/2006 | Inuzuka et al. | 345/102 |
| 2007/0002000 | A1 * | 1/2007 | Kwon | 345/102 |

* cited by examiner

*Primary Examiner* — Joe H Cheng
(74) *Attorney, Agent, or Firm* — Wells St. John, PS

(57) ABSTRACT

A backlight device for providing backlighting to a liquid crystal display panel displaying a video image comprising a plurality of light emitting devices for providing backlighting to a liquid crystal display panel, a controller unit for receiving a video image and dividing the video image into a plurality of sub-images wherein each sub-image corresponds to at least one light emitting device, and for generating driving signals of each light emitting device according to grayscale level characteristics of at least one sub-image.

24 Claims, 5 Drawing Sheets

BACKLIGHT DEVICE AND LIQUID CRYSTAL DISPLAY INCORPORATING THE BACKLIGHT DEVICE

PRIORITY CLAIM

This patent claims priority from the earlier filed Hong Kong Patent Application No. 06114098.6 filed Dec. 22, 2006, by inventors Huajun Peng, Ya-Hsien Chang, and Chen Jung Tsai, the teachings of which are incorporated herein by reference.

BACKGROUND TO THE INVENTION

1. Field of the Invention

The current invention relates to backlighting of liquid crystal displays (LCDs). More particularly, the invention relates to a backlight device for providing backlighting to a liquid crystal display panel and to a method of controlling brightness of a liquid crystal display panel.

2. Background Information

A liquid crystal display (LCD) panel is not a spontaneous light emitting device. A voltage applied to the LCD panel changes the light transmittance of liquid crystal elements (pixels) in the panel. The LCD panel can be light reflective so that an image produced on the panel is seen by ambient light reflection. However, this does not work for large size or high contrast LCD panels.

For use in applications such as televisions, computer monitors and head-held electronic devices LCD panels are illuminated from behind by a backlight. In most applications the backlight has an even and constant light output with changes in the brightness of the displayed image being controlled by changing the light transmittance of the liquid crystal elements within the display panel. In order to produce good view ability in high ambient light conditions the backlight must have a high brightness level. There are a number of disadvantages in this including high power consumption, excess heat generation. Another disadvantage of a constant backlight is that it leads to limited dynamic contrast of an LCD display because of light leakage through the LCD panel from the backlight when the pixels are in a dark or off state. This light leakage causes the dark areas to have a gray appearance instead of a solid black appearance.

One technique intended to improve the dynamic range of an LCD display is to dynamically adjust the overall backlight brightness in accordance with brightness of the video image. If the image is relatively bright, the backlight control operates the light source at high intensity. If the image is darker, the backlight output is dimmed to reduce leakage and help darken the image. One benefit to this backlight technique is to reduce the backlight power consumption. Although this technique can improve the LCD contrast range and slightly save the backlight power, it can create image S distortion and induce image brightness fluctuations.

More recently, attempts have been made to dynamically vary different areas of the backlight at different light intensities depending on the brightness of different parts of the displayed image. Such a method is described in US patent application publications 2005/0231978 and 2006/0007103.

Both of the above US patent publications described a backlighting system in which the backlight comprises an array of light emitting diodes (LEDs) arranged behind a LCD panel divided into two or more division areas. A controller of the backlight system determines the peak brightness of the displayed image within each division area and individually controls the light intensity of the LEDs behind that division area in accordance with the required brightness. Thus, when one part of a displayed image has dark colors or low brightness levels the backlight LEDs behind that portion of the image have a low light output whereas in another part of the displayed image with light colors or high brightness the corresponding LEDs of the backlight have a highlight light output.

The above described methods, and other methods practiced hitherto, still suffer from several drawbacks including undesirable image color distortion and brightness distortion.

SUMMARY OF THE INVENTION

Accordingly, is an object of the present invention to provide a backlight device for providing backlighting to a liquid crystal display panel and a method of controlling brightness of a liquid crystal display panel which overcomes or substantially ameliorates the above problems.

There is disclosed herein a backlight device as claimed in claims 1 through 10, and a liquid crystal display device and system as claimed in claims 11 through 23.

Further aspects of the invention will become apparent from the following description.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

Figure 1:
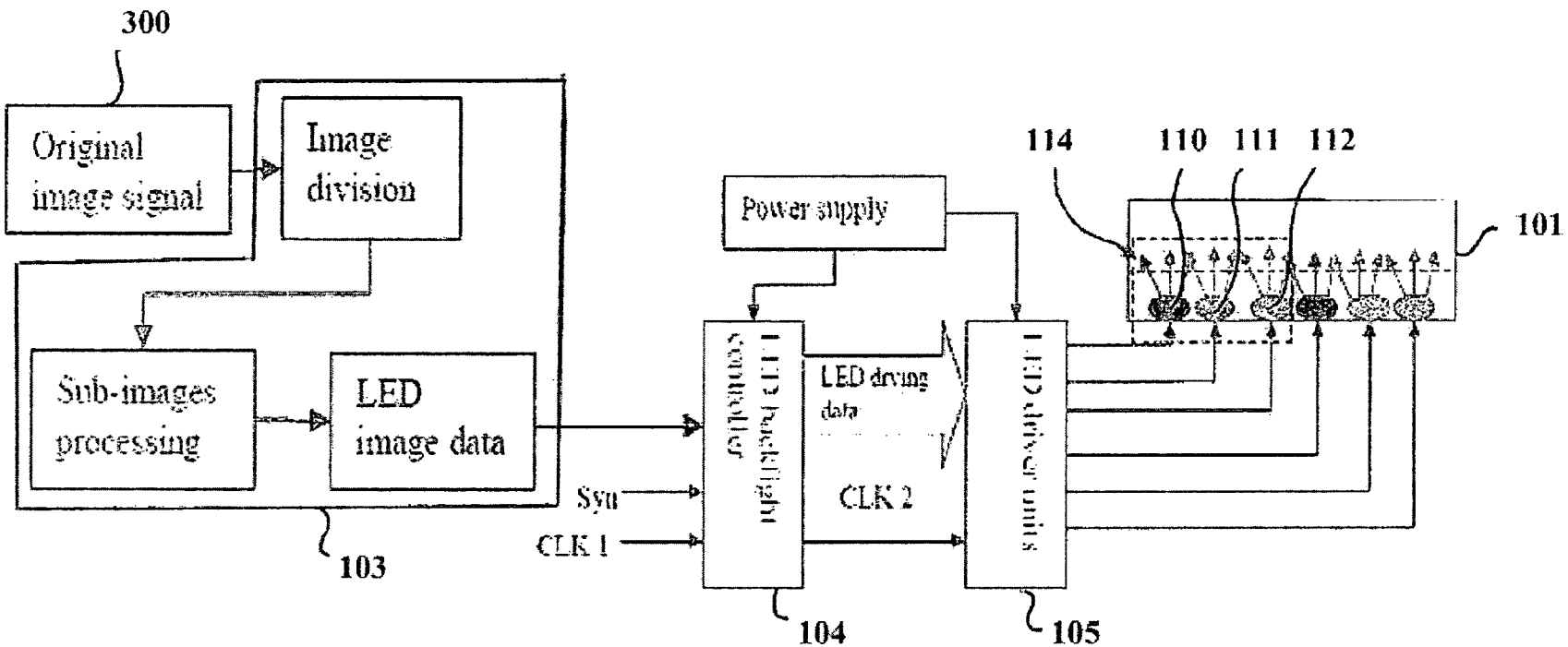
FIG. 1 is a schematic illustration of a backlighting device for an LCD panel according to the invention.

Reference will now be made in detail to the exemplary embodiments of the present invention, examples of which are illustrated in the accompanying drawings, wherein like reference numerals refer to like elements throughout.

Figure 3A:
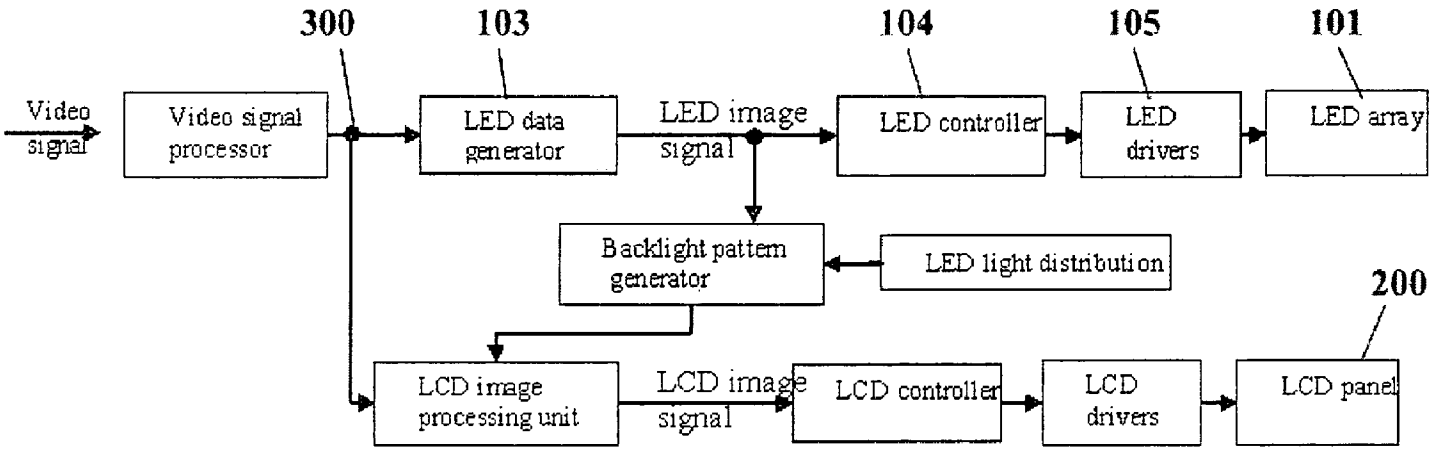
FIG. 3*a* is a block diagram showing the construction of a LCD device using a backlighting device according to the invention.
Figure 3B:
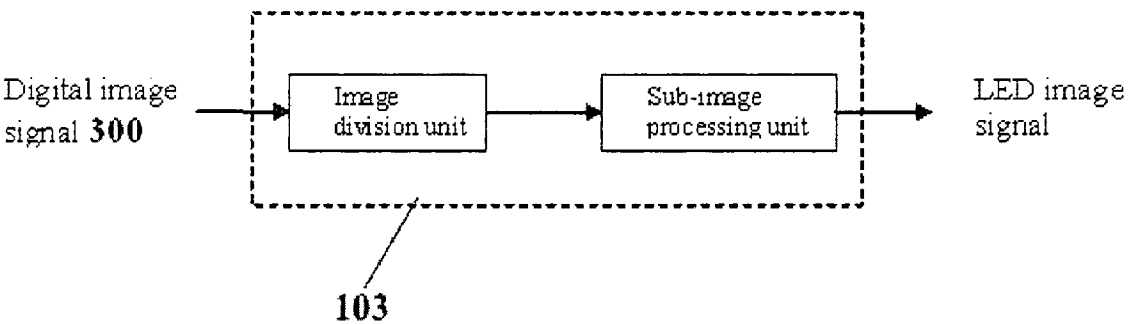
FIG. 3*b* is a block diagram showing the construction of the LED image generator.

Referring to FIGS. 1 and 3 of the drawings, there is shown a preferred embodiment of a backlight device 100 for providing backlighting to a liquid crystal display (LCD) panel 200 in accordance with the invention. The backlight device 100 according to this embodiment comprises a light emitting devices (LEDs) array 101 and a control unit arranged to provide backlight to an LCD panel 200. For the purpose of illustrating the invention the LCD panel 200 is divided into M×N (where M is the number of columns and N the number of rows) division areas 201 shown with dashed lines 202. In the illustrated embodiment there are shown 21 division areas in 3 columns and 7 rows. This is not intended to limit the scope of use or functionally of the invention and there could be more or less division areas and the division areas are not limited to rectangular, also the division areas can be overlapped at the boundaries. For example each liquid crystal element of the LCD panel could represent one division area or each pixel in a display could represent one division area.

The backlight device has a backlight panel 101 on which there is mounted a plurality of light emitting diodes (LEDs) 10, 111, 112 arranged in an array. In the illustrated embodiment there is one LED group 114 corresponding to per division area 201 of the LCD panel 200. This group 6 comprises of one red LED 110 emitting red color, one green LED 111 emitting green color and one blue LED 112 emitting blue color. When the output luminous fluxes of the red, green and blue LEDs 110, 111, 112 match a predetermined ratio, for example, R;G:B=3:6:1, the LED group 114 generates white light by mixing the R, G, and B light and emits this white light to the LCD panel 200. Again, this is not intended to limit the scope of use or functionally of the invention and there could be more LEDs for each LED group 114, and there could be more LED groups corresponding one each divisions 201.

The control unit comprises an LED image generator 103 which analyzes the input digital image signal 300 and generates LED image signal, a LED controller unit 104 and a plurality of LED drivers 105.

Figure 2:
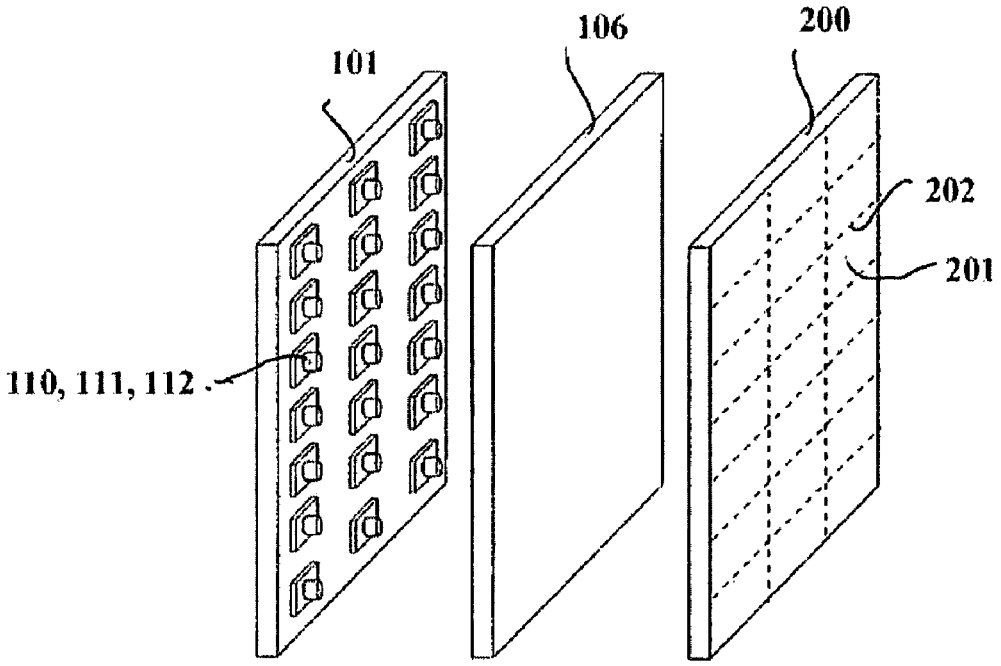
FIG. 2 is an exploded schematic illustration of the backlight device light panel.

The LED image generator 103 receives the digital video signal 300 having a format adaptive to a display part, namely, the LCD panel 200. For example, the LCD panel has a resolution of 1366*RGB*768, namely, 1366 (column) *768 (row) LCD pixel, each pixel comprises of one red sub-pixel, one green sub-pixel and one blue sub-pixel. The input digital image signal 300 has a format corresponding to each sub-pixel of the whole panel, containing the grayscale level information for each sub-pixel. One frame of the input video signal corresponds to one full image having the same resolution as the LCD panel 200. The LED image generator 103 comprises an image division sub-unit and a sub-image processing sub-unit as shown in the FIG. 3*b*. The image division unit divides the image into sub-images corresponding to the numbers division areas 201 of LCD panels, which in FIG. 2 is 21 (3×7). For each division area 201 there is one red sub-image, one green sub-image and one blue sub-image.

Figure 5:
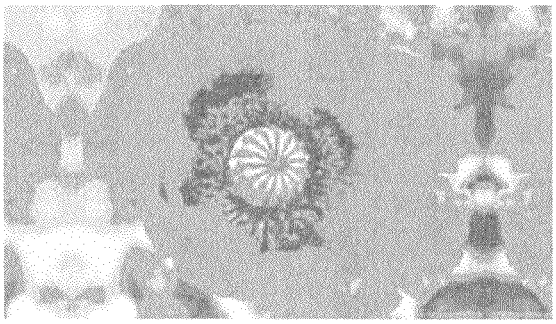
FIG. 5 illustrates a sample grayscale image such as one frame of a video signal.
Figure 6A:
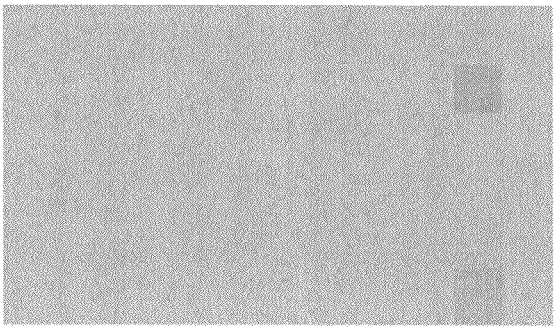
FIGS. 6*a*-6*c* are schematic illustrations of the image of FIG. 5 divided into sub-image groups for each nominal color (Red, Green, Blue)
Figure 6B:
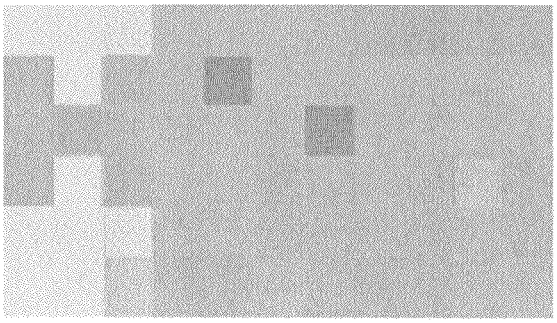
Figure 6C:
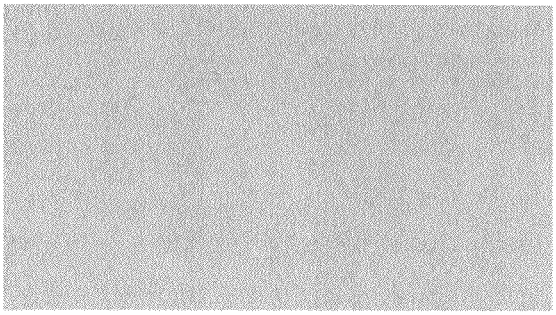

FIG. 5 is an illustration of a sample image such as one frame of a video signal. FIGS. 6*a*-6*c* are illustrations of one red sub-image, one green sub-image and one blue sub-image respectively of from the image of FIG. 5. There are 11×6 or 66 division areas shown in the Images of FIGS. 6*a*-6*c*.

The sub-image processing unit then processes the sub-images extracting the mean-average grey scale level for each red sub-image, each green sub-image and each blue sub-image. The LED grayscale signal is then given according to the mean-average grey scale level of the corresponding sub-image. For example, the LED grayscale level is equal to the mean-average grayscale level of the corresponding sub-image. The Red LED grayscale level is obtained according to the mean average grayscale level of the corresponding red sub-image. Likewise, the Green and Blue LEDs grayscale levels are obtained according to the mean average grayscale levels of their corresponding sub-images. For example, in FIGS. 6*a*-6*c* each division area is shaded in its mean-average grayscale level of the corresponding red sub-images, green sub-images, and blue sub-images, respectively, of the color image.

The LED backlight controller 104 receives the LED image signal which contains the information of grayscale levels of each LED and clock signal and synchronization signal. The synchronization signal is to make the LED image display in synchronization with the image data signal to the LCD panel 200. The LED backlight controller 104 then transforms the LED image data and transmits them to the corresponding LED drivers 105 in accordance with the address of the LEDs in the backlight board 101.

The LED driver 105 drives the respective R-, G-, B-LEDs 110, 111, 112 to emit light or not emit light and adjust an intensity of the emitted light on the basis of a control signal from the LED backlight controller 104. The backlight driver 104 powers the LEDs 110, 111, 102 with a pulse width modulated (PWM) signal. The LED driver 105 adjusts both the intensity of electric current and duty cycle of the PWM to be applied to the respective R-, G-, B-LEDs 110, 111, 112, and therefore adjusts the intensity of the light emitted from the respective R-, G-, B-LEDs 110, 111, 112, thereby adjusting a white balance or color tone of an image displayed by the LCD panel 200.

According to a second embodiment of the invention, instead of the LED image generator 103 extracting the mean-average grey scale level for each sub-image it extracts the peak scale level for each red sub-image, each green sub-image and each blue sub-image. The LED grayscale signal is then given according to the peak grey scale level of the corresponding sub-image. For example, the LED grayscale level is equal to the peak grayscale level of the corresponding sub-image. The Red LED grayscale level is obtained according to the peak grayscale level of the corresponding red sub-image. Likewise, the Green and Blue LEDs grayscale levels are obtained according to the peak grayscale levels of their corresponding sub-images.

According to a third embodiment of the invention, instead of the LED image generator 103 extracting the mean-average or peak grayscale level for each sub-image it extracts and compares the mean-average or peak grey scale level for each red sub-image, each green sub-image and each blue sub-image in each division area and then obtains the maximum mean-average grayscale or maximum peak grayscale level. The LED grayscale signal is then given according to the maximum mean-average grey scale or maximum peak grayscale level of the corresponding sub-images. For example, grayscale levels of red LED, green LED and blue LED are identical and equal to the maximum mean-average grayscale level or maximum peak grayscale of the corresponding sub-images. (It might be better to give one more embodiment to state the case of maximum peak grayscale)

According to a forth embodiment of the invention the LED group 114 comprises just one or more white LEDs and instead of the LED image generator 103 extracting the mean-average or peak grayscale level for each sub-image it extracts and compares the mean-average grey scale level for each red sub-image, each green sub-image and each blue sub-image in each division area and then obtains the maximum mean-average grayscale level. The LED grayscale signal is then given according to the maximum mean-average grey scale level of the corresponding sub-images. For example, grayscale levels of white LED(s) is/are equal to the maximum mean-average grayscale level of the corresponding sub-images.

In the embodiments one to four given above each LED group 114 corresponds to one division area 201 of the LCD panel 200. In other embodiments of the invention there may be more LED groups associated with each division area or more than one divisional area associated with each LED group.

In a fifth embodiment of the invention one group of LEDs 114 including RGB LEDs 110, 111, 112 corresponds to one division area 201 with multiple neighboring division areas. The LED image generator 103 then processes the sub-images, for example, extracting the mean-average grey scale level for each red sub-image, each green sub-image and each blue sub-image. The LED grayscale signal is then given according to the mean-average grey scale level of the corresponding sub-image and sub-images of neighboring division areas weighted by different factors. For example, the LED grayscale level is equal to the summation of mean-average grayscale level of the corresponding sub-image multiplied by a factor of 0.8 and mean-average grayscale levels of sub-images of four neighboring division areas weighted by a factor of 0.05 for each.

In variations of the fifth embodiment peak and maximum mean-average grayscale levels are used with the weighting factors for neighboring division areas.

According to a sixth embodiment of the invention a liquid crystal display devices uses the LED backlight of the preferred embodiment given above. The liquid crystal display device comprise a liquid crystal panel 200, a LED backlight array 101 as described above and a control unit to processing the input video data.

Referring to FIG. 3, the video signal decoding unit receives a video signal, and transform the video signal to a digital image signal which has the adaptive format of the liquid crystal panel, as is known in the art. These digital image signal contain the grayscale level information of the corresponding LCD pixels. Based on the grayscale level, the LCD drivers control the transmittance of the LCD pixel. The work principle of an LCD panel can be found in US patent application publications US20060262077 or US20060109389, or U.S. Pat. No. 7,064,740.

The video signal decoding unit may have various configurations corresponding to that of the LCD controller. For example, video signal decoding unit may comprise an analog input terminal to transmit an input analog video signal to an analog/digital (A/D) converter, and a digital input terminal to support a low-voltage differential signaling (LVDS) or a transition minimized differential signaling (TMDS) interface for a digital video signal output.

The LED image generator 103 processes the incoming digital image signal 300 to generate and transmit LED image signal to the LED backlight controller 104, simultaneously generate and transmit an LED image signal to the LED controller. The incoming video image single is passed to the LCD control unit which processes the image and then via LCD controller and LCD driver controls the LCD panel. Simultaneously the digital image signal 300 is passed to the backlight control unit. The first step in processing the image is image division. The original image is divided into multiple blocks corresponding to each division area of the LCD panel. The minimum number of blocks is one meaning that all LEDs in the LED matrix array will be driven with the same light output as in known backlight systems. The maximum number of blocks corresponds to the maximum number of LCD panel divisions which as mentioned previously might correspond to the number of liquid crystal elements in the LCD panel or the number of pixels in the display. For physical reason this must correspond to the number of LEDs on the backlight panel.

After the image is divided into individual blocks it is processed to determine brightness information for the video image in that block. The brightness value may be based on an average or peak value or maximum-average grayscale value of the image. The controller then determines a light output intensity signal based on this brightness information and on information concerning the light spread characteristics of the optical panel 106 as will be discussed below. The LED image signal is then passed to the LED controller 104 which is in communication with LED driver 105 for individually operating each of the LEDs 110, 111, 112 in the LED backlight panel 101.

Figure 4:
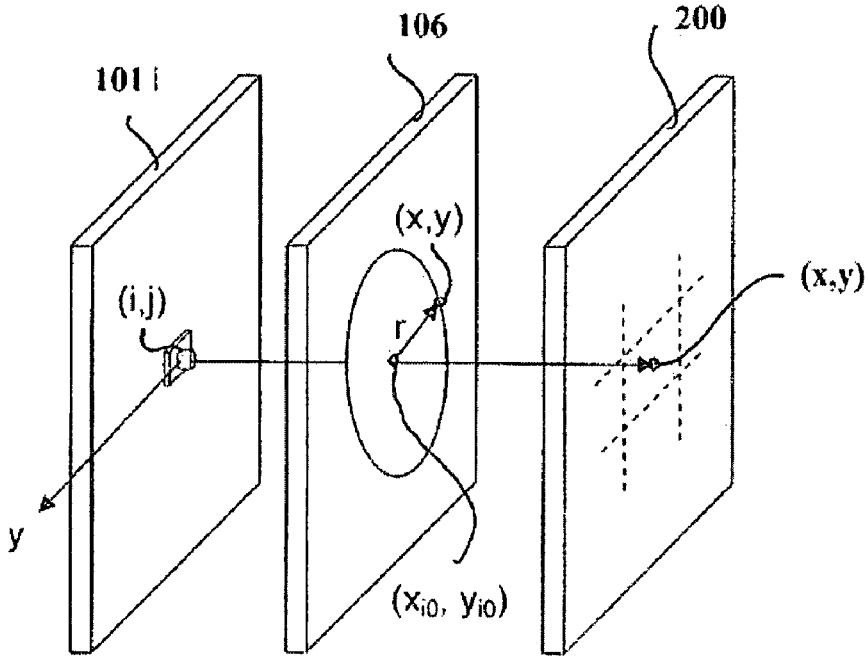
FIG. 4 is a schematic illustration of light spatial distribution from the backlight.
Figure 7A:
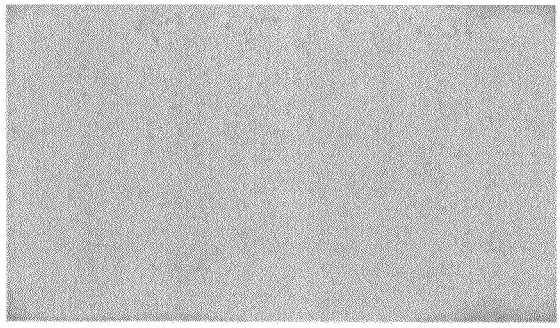
FIGS. 7*a*-7*c* are schematic illustrations of the backlight brightness patterns for each groups of sub-images of FIGS. 6*a*-6*c*.
Figure 7B:
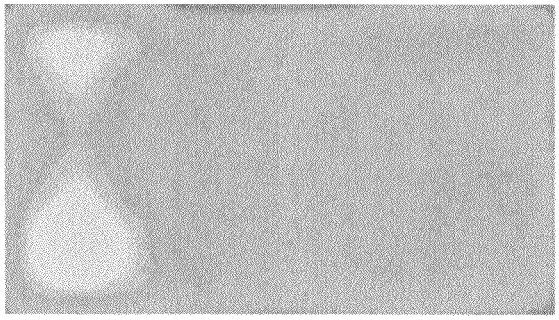
Figure 7C:
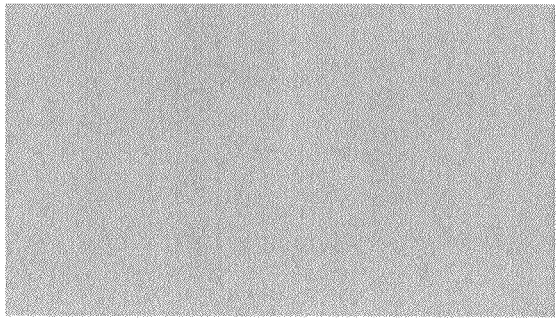
Figure 8:
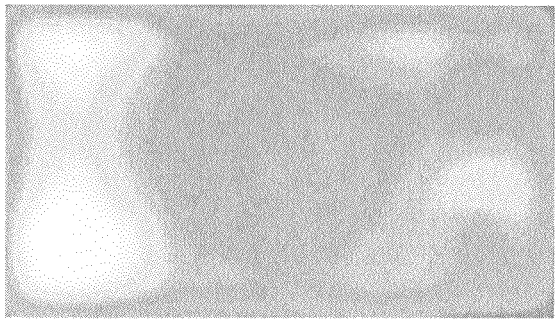
FIG. 8 is a schematic illustration of the final backlight brightness pattern for the image of FIG. 5.

The LEDs of the backlight preferably emits light which is somewhat diffuse so that the light intensity varies reasonably smoothly on the backside of the LCD panel 200 after passing through an optical panel 106 which are preferably inserted between the LED backlight 101 and the LCD panel 200. The optical panel 106 is a light transmissive backlight optical panel which may comprise a diffuser plate, diffuser file, brightness enhanced film (BEF) or dual brightness enhanced film (DBEF) to enhance the light diffusion. FIG. 4 illustrates how the light from an LED at point (i,j) in the LED backlight board spreads as it passes through the backlight optical panel. The size of an LED is usually no larger than 9 mm2 (3 mm×3 mm), but the spread area after the light has passed through the backlight optical panel can be larger than 5 cm2. This can be larger than the chosen division area 201 of the LCD panel 200. FIG. 4 is an exploded view so the LCD panel is moved further away from the optical panel. The normalized light diffusion profile of a LED is independent of the LED light intensity. The backlight brightness below a LCD pixel is contributed to by all LEDs intensity convolved with their corresponding diffusion profiles. Therefore, after the LED image is generated, the brightness level of backlight at each LCD pixel can be obtained. FIG. 7*a*, 7*b*, and 7*c* give the mono-color backlight brightness pattern for red color, green color and blue color respectively.

The brightness (B) of a pixel at position (x,y) is given by $B=L\cdot T$ where L is brightness level of the backlight and T is the transmittance of the LCD panel at pixel (x,y). Rearranging in terms of T gives $T=B/L(x,y)$.

The contrast of a LCD display is the ratio of the highest brightness to the lowest brightness and is given by $R=B_{max}/B_{min}=(L_{max}\cdot T_{max})/(L_{min}\cdot T_{min})$. In a prior art constant backlight LCD panel $L_{max}=L_{min}=L$ for all pixels and so $R=T_{max}/T_{min}$.

In this invention, LEDs of the backlight are individually controlled. The brightness of the backlight is not uniform and varies with the image. As described above, the imaging processing unit extracts LED image signals from the input video image data. The backlight brightness can be achieved by convolving the LED image signal with their corresponding spatial distribution. The backlight brightness at (x,y) is changed to L'(x,y), where $L'(x,y)\leqq L(x,y)$. Thus, the whole backlight brightness is generally dimmer than that of a prior art constant backlight system. To keep the viewable brightness of the image noticeably unchanged the LCD panel transmittance T is adjusted such that $T'(x,y)=B'/L'(x,y)\geqq T$. where $B'\leqq B$ and B is the original brightness of image.

The backlight brightness behind dark image areas is very low, even zero, so that LCD light leakage is minimized to increase image contrast.

The contrast ratio of an LCD display according to the invention can be expressed as $CR'=B\ sax/B'_{min}=(L'_{max}-T'_{max})/(L'_{min}\cdot T'_{min})=(T'_{max}/T'_{min})-(L'_{max}/L'_{min})$. The maximum and minimum transmittances of a LCD display are dependent on the physical structure of the device, not on the image video signal. Therefore, $T'_{max}=T_{max}$ and $T'_{min}=T_{min}$ and thus the contrast ration of a LCD using a backlight according to this invention can be significantly enhanced.

Increasing the liquid crystal transmittance means increasing the grayscale level of the LCD image to be sent to the LCD controller. To obtain a higher grayscale level, the original video image signal is adjusted in the LCD image processing unit. Also increasing the liquid crystal transmittance induces the driving voltage. Because the LCD is a voltage driven device, voltage variations just cause a minor change in the power consumption. Reduction of backlight luminance will result in large savings in power.

Because the human eye is more sensitive to the relative brightness than to the absolute brightness of an image, preservation of each pixel's brightness is not necessary. For example, the human eye is less able to detect detail in dark areas or an image and so to enhance the image details in the dark areas of an the LCD image the signal in the dark area can be adjusted more, i.e. $T'(x,y)>B/L'(x,y)$. In the bright area the LCD image the signal can be adjusted less so that $T \leqq T'(x,y) < B/L'(x,y)$.

Other embodiments of liquid crystal display devices are based on the same LCD compensation mechanism and varied LED backlight structure.

It should be appreciated that modifications and alternations obvious to those skilled in the art are not to be considered as beyond the scope of the present invention.

The invention claimed is:

1. A backlight device for providing backlighting to a liquid crystal display panel displaying a video image, comprising:

a plurality of light emitting devices for providing backlighting to a liquid crystal display panel;

a controller unit for receiving a video image and dividing the video image into a plurality of sub-images wherein each sub-image corresponds to at least one light emitting device, and for generating driving signals of each light emitting device according to grayscale level characteristics of at least one sub-image; the sub-images being overlapped at the boundaries thereof, each sub-image grayscale level characteristic being the average grayscale level value of each image pixel in the sub-image or the weighting grayscale level values of grayscale level histogram of image pixels in the sub-image and/or their combination.

2. The backlight device as claim 1 wherein the controller unit further comprise a plurality of drivers and each driver receives one of the driving signals and individually drives at least one light emitting devices light output.

3. The backlight device of claim 1 wherein each light emitting device comprises at least one white light LED.

4. The backlight device of claim 1 wherein each light emitting device comprises at least one red light LED, one blue light LED and one green light LED.

5. The backlight device of claim 4 wherein the each sub-image further comprising at least a red color sub-image, a green color sub-image and a blue color sub-image.

6. The backlight device of claim 5 wherein the driving signals further comprise driving signals for each red light LED, green light LED and blue light LED generated according to grayscale level characteristic of each corresponding red color sub-image, green color sub-image, blue color sub-image respectively.

7. The backlight device of claim 5 wherein the driving signal of each red light LED, green light LED and blue light LED is generating by weighting the grayscale level characteristics of each corresponding red color sub-image and its neighboring red color sub-images, green color sub-image and its neighboring green color sub-images, blue color sub-image and its neighboring sub-images respectively.

8. The backlight device of claim 5 wherein the red light LEDs, blue light LEDs and green light LEDs are individually and time sequentially controlled and emitting light.

9. The backlight device of claim 1 wherein the controller unit further adjusts the video image output based on the light distribution of the plurality of light emitting devices.

10. The backlight device of claim 1 wherein each light emitting device comprises red, green and blue light emitting diodes, each sub-image being further divided into red, green and blue image component-images and generating driving signals of each red, green and blue light emitting diodes according to grayscale level characteristics of respective red, green and blue component-images.

11. A liquid crystal display device, comprising:

a liquid crystal panel;

a plurality of light emitting devices for providing backlighting for the liquid crystal panel;

a controller unit for receiving a video image and dividing the video image into a plurality of sub-images wherein each sub-image corresponds to at least one light emitting device, and generating driving signals for each light emitting device according grayscale level characteristics of at least one sub-image, the sub-images being overlapped at the boundaries thereof, each sub-image grayscale level characteristic being the average grayscale level value of each image pixel in the sub-image or the weighting grayscale level values of grayscale level histogram of image pixels in the sub-image and/or their combination, and for adjusting the video image signal based on the brightness and light spatial distribution of the plurality of light emitting devices.

12. The liquid crystal display device as claim 11 wherein the liquid crystal panel comprising a plurality of pixels and each pixel comprising a red sub-pixel, a blue sub-pixel and a green sub-pixel.

13. The liquid crystal display device as claim 11 wherein the controller unit further comprise a plurality of drivers and each driver receives one of the control signals and individually controls at least one light emitting devices light output.

14. The liquid crystal display device as claim 11 wherein each light emitting device comprises at least one white light LED.

15. The liquid crystal display device as claim 14 wherein the driving signal of each light emitting diode is generated by weighting the grayscale level characteristics of each corresponding sub-image and its neighboring sub-images.

16. The liquid crystal display device as claim 11 wherein each light emitting device comprises at least one red light LED, one blue light LED and one green light LED.

17. The liquid crystal display device as claim 16 wherein the each sub-image further comprising a red color sub-image, a green color sub-image and a blue color sub-image.

18. The liquid crystal display device as claim 17 wherein the driving signal of each red light LED, green light LED and blue light LED is generated according to the grayscale level characteristic of each corresponding red color sub-image, green color sub-image and blue color sub-image respectively.

19. The liquid crystal display device as claim 17 wherein the driving signal of each red light LED, green light LED and blue light LED is generated by weighting the grayscale level characteristics of each corresponding red color sub-image and its neighboring red color sub-images, green color sub-image and its neighboring green color sub-images, blue color sub-image and its neighboring sub-images respectively.

20. The liquid crystal display device as claim 16 wherein the red light LEDs, blue light LEDs and green light LEDs corresponding to respective red sub-pixels, green sub-pixels and blue sub-pixels and are time sequentially and synchronized on-off.

21. The backlight device of claim 11, wherein the controller unit is for adjusting the video image signal to change the transmittance T of a pixel at position (x, y) in the liquid crystal panel, such that $$T'(x, y)=B'/L'(x, y)>=T$$

wherein T=B/L (x. y); L being the original brightness level of one light emitting device corresponding to the pixel; B being the original brightness of the pixel at position; L' being the changed brightness level of the light emitting device corresponding to the pixel; T being the original transmittance of the pixel at position; and B' being the changed brightness of the pixel.

22. The backlight device of claim 11 wherein each light emitting device comprises red, green and blue light emitting diodes, each sub-image being further divided into red, green and blue image component-images and generating driving signals of each red, green and blue light emitting diodes according to grayscale level characteristics of respective red, green and blue component-images.

23. A liquid crystal display system, comprising:

a liquid crystal panel;

a plurality of light emitting devices for providing backlighting for the liquid crystal panel;

an image processing unit for receiving and processing a video image;

a controller unit for receiving the processed video image from the image processing unit and dividing the video image into a plurality of sub-images wherein each sub-image corresponds to at least one light emitting device, and generating driving signals of each light emitting device according grayscale level characteristics of at least one sub-image, the sub-images being overlapped at the boundaries thereof, each sub-image grayscale level characteristic being the average grayscale level value of each image pixel in the sub-image or the weighting grayscale level values of grayscale level histogram of image pixels in the sub-image and/or their combination, and for adjusting the video image signal based on the brightness and light spatial distribution of the plurality of light emitting devices and outputting the adjusted video image to the liquid crystal panel.

24. A liquid crystal display system, comprising:

a liquid crystal panel;

a plurality of light emitting devices for providing backlighting for the liquid crystal panel;

an image processing unit for processing and outputting a video image to the liquid crystal panel;

a controller unit for receiving a video image and scaling the video image to fit the liquid crystal panel, and dividing the video image into a plurality of sub-images wherein each sub-image corresponds to at least one light emitting device, and generating driving signals of each light emitting device according grayscale level characteristics of at least one sub-image, the sub-images being overlapped at the boundaries thereof, each sub-image grayscale level characteristic being the average grayscale level value of each image pixel in the sub-image or the weighting grayscale level values of grayscale level histogram of image pixels in the sub-image and/or their combination, and for adjusting the video image signal based on the brightness and light spatial distribution of the plurality of light emitting devices and outputting the adjusted video image to the image processing unit.

* * * * *